United States Patent [19]

Fox

[11] 4,390,062

[45] Jun. 28, 1983

[54] DOWNHOLE STEAM GENERATOR USING LOW PRESSURE FUEL AND AIR SUPPLY

[75] Inventor: Ronald L. Fox, Albuquerque, N. Mex.

[73] Assignee: The United States of America as represented by the United States Department of Energy, Washington, D.C.

[21] Appl. No.: 222,863

[22] Filed: Jan. 7, 1981

[51] Int. Cl.[3] ..... E21B 43/24

[52] U.S. Cl. ..... 166/59; 431/157; 431/162

[58] Field of Search ..... 166/59, 57, 303, 302; 431/157, 162, 164, 115

[56] References Cited

U.S. PATENT DOCUMENTS

| | | | |
|---|---|---|---|
| 3,204,696 | 7/1965 | De Priester et al. | 166/59 |
| 3,759,329 | 9/1973 | Ross | 166/303 X |
| 4,243,098 | 1/1981 | Meeks et al. | 166/59 |

OTHER PUBLICATIONS

Fox et al., "Analysis of the Injection of Steam into Deep Reservoirs for Recovery of Tertiary Oil, 17th Aerospace Sciences Meeting, New Orleans, LA, Jan. 1979, (Sandia Laboratories Public. SAND-0202).

*Primary Examiner*—Stephen J. Novosad

[57] ABSTRACT

An apparatus for generation of steam in a borehole for penetration into an earth formation wherein a spiral, tubular heat exchanger is used in the combustion chamber to isolate the combustion process from the water being superheated for conversion into steam. The isolation allows combustion of a relatively low pressure oxidant and fuel mixture for generating high enthalpy steam. The fuel is preheated by feedback of combustion gases from the top of the combustion chamber through a fuel preheater chamber. The hot exhaust gases of combustion at the bottom of the combustion chamber, after flowing over the heat exchanger enter an exhaust passage and pipe. The exhaust pipe is mounted inside the water supply line heating the water flowing into the heat exchanger. After being superheated in the heat exchanger, the water is ejected through an expansion nozzle and converts into steam prior to penetration into the earth formation. Pressure responsive doors are provided at a steam outlet downstream of the nozzle and close when the steam pressure is lost due to flameout.

4 Claims, 5 Drawing Figures

5
14
15
17
4
8
11
5
17
11
11
2
2
9
26
27
6
12
10
25
6
7
1
3
3
18
22
14
21
11
21
4
4
19
20
13
30
29
29
28
28

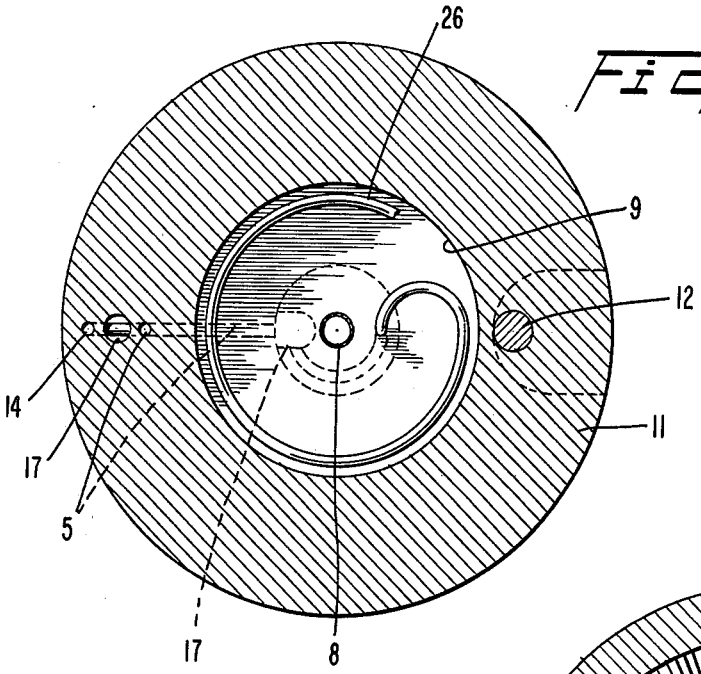
Fig. 2
Fig. 3
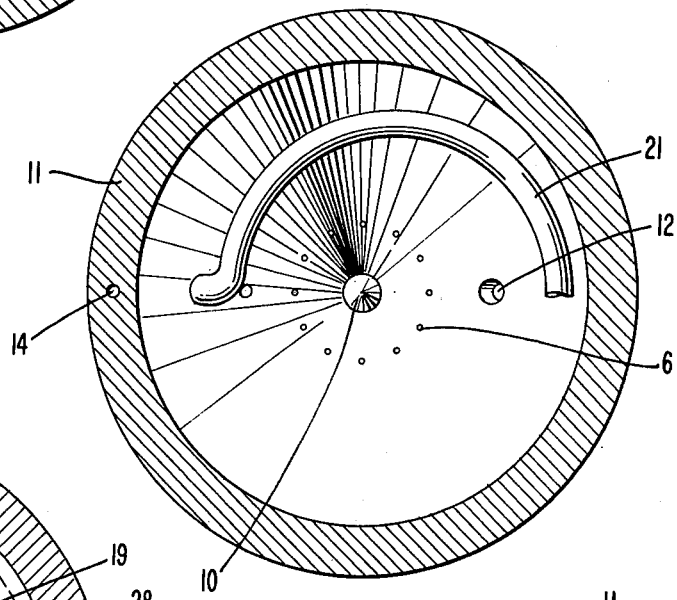
Fig. 4
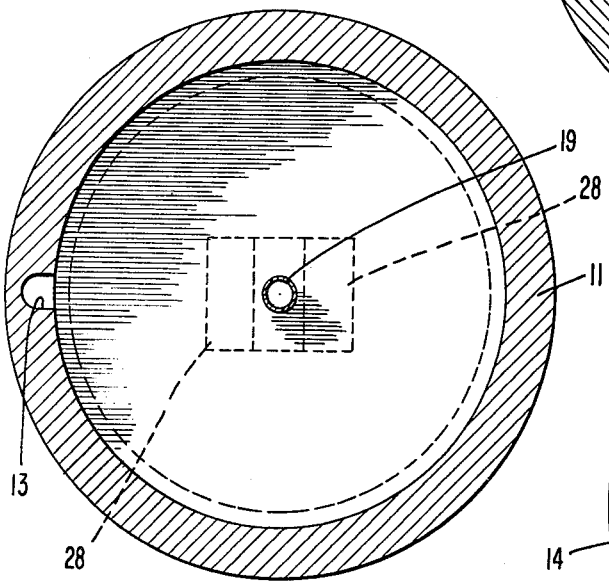
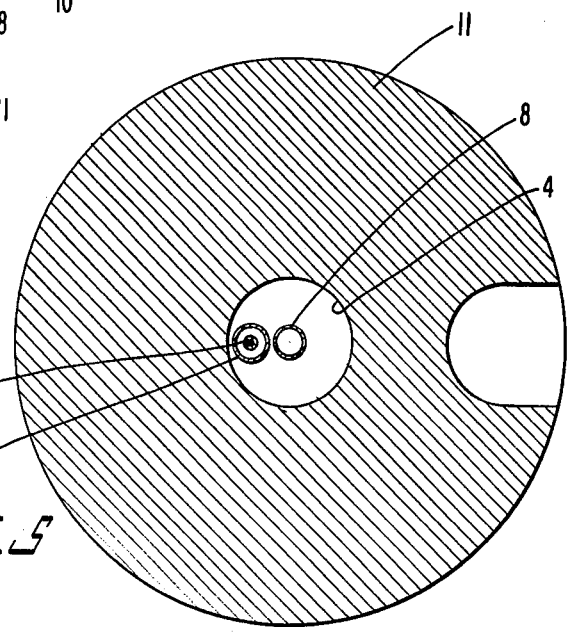
Fig. 5

DOWNHOLE STEAM GENERATOR USING LOW PRESSURE FUEL AND AIR SUPPLY

The United States Government has rights in this invention pursuant to Contract No. AT (29-1)-789 and modifications between the U.S. Department of Energy and Western Electric Company, Incorporated.

BACKGROUND OF THE INVENTION

The invention is in the area of tertiary oil recovery techniques, in particular, an improved apparatus for downhole injection of steam into boreholes.

In the art of recovering oil from earth formations, tertiary methods are increasing in their importance. Initially, oil flow from many wells is driven by the pressure due to natural gases trapped along with the liquid oil in the formation. With the passage of time, natural gas pressures decrease. When gas pressure is insufficient to drive oil to the surface, pumping methods are then employed. As time passes, pumping methods may be ineffective because the flow of oil underground out of porous formations into a well may be very slow. It is at this point that tertiary methods are sought to accelerate the flow of oil from the formation into the well.

A particularly useful tertiary method employs the injection of steam. Steam serves to heat the oil in the formation, thereby reducing its viscosity and increasing its flow rate into the well for recovery.

Methods employing downhole generation of steam within a well have proved to be particularly advantageous. The prior art discloses several representative methods and apparatus.

In U.S. Pat. No. 3,456,721, Smith discloses a downhole burner for generating steam. Gaseous or liquid fuels are mixed with air and combusted in a burner with simultaneous spraying of water toward the flame. The water is sprayed from a cylindrical water jacket through a plurality of orifices. Steam is formed by the vaporization of the water as the water bombards the flame.

In U.S. Pat. No. 3,980,137, Gray discloses a downhole steam injector employing the combustion of hydrogen with oxygen to generate heat to vaporize injected water to form steam. The water moves through an annular preheater jacket surrounding the combustion chamber and, after being preheated, enters the combustion chamber through a plurality of grooves or passages at the top of the combustion chamber near the igniter and the hydrogen/oxygen flame.

Hamrick et al in their related U.S. Pat. Nos. 3,982,591 and 4,078,613 disclose downhole steam generators. In the first patent, in FIG. 17, water is injected through a plurality of apertures directly into the flame in a hydrogen/oxygen combustion zone. In the second patent, in FIG. 2B, water moves through a cooling annulus before it is injected into a mixing zone spaced below the combustion zone. The mixing zone is defined by a cylindrical wall which has a plurality of apertures through which water from the cooling annulus passes laterally into the mixing zone. A heat resistant liner is placed along the interior of the combustion zone.

Several problems have been encountered with these prior art downhole steam generators. One problem is the tendency of the flame in the combustion chamber to be quenched by water injected directly into the flame to produce steam.

An additional problem related to the direct injection of water into the combustion zone is wetting the sparkplug or igniter, thereby reducing the efficiency of combustion.

A problem related to inefficient combustion is the formation of soot. Soot has two deleterious effects. One is air pollution, and the other is the tendency to clog the pores in the earth formation, thereby impeding oil flow out of the formation into the production well.

Another problem relates to the products of combustion which are acidic gases such as carbon dioxide, sulfur oxides, and nitrogen oxides. In certain types of earth formations, it is undesirable to contact the formation with the acidic products of combustion.

Another undesirable aspect of prior art downhole steam generators is the necessity for supplying both fuel and oxidant downhole at relatively high pressures. Expensive high pressure compressors are required for the oxidant, namely air. Expensive high pressure pumps are required for the fuel, namely a liquid hydrocarbon such as diesel fuel, fuel oil or kerosene.

Problems are also encountered relative to the efficient preheating of the fuels and water used in the downhole steam generator. To explain, liquid fuels may be relatively cold at the surface prior to pumping downhole. As a result, the combustion process itself, must give up heat to the liquid fuel to bring it up to combustion temperatures. Cool fuel, results in production of soot, which is undesirable because of surface air pollution or clogging of pores in the earth formation. Similarly, water may be relatively cold at the surface prior to pumping downhole. As a result, a considerable portion of the heat generated by the combustion process is consumed in bringing the water up to the boiling point. Thus, less energy is available for production of high enthalpy steam.

With prior generators, conditions downhole may occur which tend to flood the combustion zone with reservoir fluids. This occurs particularly when a temporary interruption of combustion is encountered. A need for isolating the combustion chamber from reservoir fluids is thus indicated.

SUMMARY OF THE INVENTION

In view of the deficiencies and inadequacies described above, it is an object of the invention to provide an apparatus for downhole steam generation in which water is not injected directly onto the flame in the combustion chamber providing more reliable operation.

Another object of the invention is to provide a downhole steam generator isolating the combustion process from the reservoir pressure thus requiring less fuel and oxidant (air) pressure and reducing the problems associated with high pressure combustion.

A related object of the invention is to provide a downhole steam generator system in which the fuel and oxidant are supplied to the combustion chamber at relatively low pressures, thereby eliminating the need for expensive high pressure compressors and high pressure pumps.

Another object of the invention is to provide a downhole steam generator in which the hot exhaust gas formed during the combustion process is prevented from entering the earth formation but is used to preheat the fuel and oxidant (air).

Still another object of the invention is to provide a downhole steam generator in which water used for steam generation is efficiently preheated by exhaust gases prior to conversion to steam.

Still another object of the invention is to provide a downhole steam generator in which acidic gaseous products and any soot generated by combustion are prevented from entering the earth formation.

An additional object of the invention is to provide a downhole apparatus for efficiently superheating water for generating steam in a heat exchanger in the combustion chamber, thus isolating the combustion process from the reservoir pressures.

Still an additional object of the invention is to provide a downhole steam generator with a heat exchanger having an expansion nozzle for converting superheated water to steam.

Still an additional object of the invention is to provide a downhole steam generator with a heat exchanger and having doors downsteam of the steam expansion nozzle to protect the heat exchanger from being flooded in the event of flameout.

Additional objects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purposes of the present invention as described herein, an apparatus for generation of steam in a borehole for penetration into an earth formation is described including: an oxidant supply; a fuel supply providing fuel to be combusted with the oxidant; an igniter igniting the fuel/oxidant; a water supply providing water for conversion into steam; and a combustor assembly.

The combustor assembly includes a combustion chamber, an exhaust gas pipe for venting the products of combustion out of the borehole, and a heat exchanger for generating superheated water in the combustion chamber. An expansion nozzle converts the superheated water in the heat exchanger into steam as the steam is ejected into the borehole through a steam outlet. The heat exchanger preferably includes a heat exchange tube spirally traversing the combustion chamber. This effectively isolates the water being heated from the products of combustion.

Because the generated steam is isolated from the products of combustion, the high pressures developed by the steam to penetrate the earth formation need not be developed in the combustion process itself. Thus, the fuel and oxidant supplied to the combustion chamber need not be supplied at high pressures. As a result, high pressure compressors and high pressure pumps are not needed for the downhole steam generator of the present invention.

By isolating products of combustion from the borehole, the earth formation is also prevented from being exposed to any soot that may result from an incomplete combustion process. Thus, clogging of pores in the earth formation is alleviated. Furthermore, by venting products of combustion out of the borehole, acidic products of combustion do not contact the earth formation. In some formations, such acidic contact is undesirable.

Isolation of the combustion process from the steam generation has other advantages. Neither the combustion flame nor the igniter is exposed to water during production of steam. Thus, the combustion flame is not susceptable to being quenched; and it is not possible for the igniter to be wetted and thus rendered inoperative. Thus, conditions causing faulty start-up or incomplete and inefficient combustion are precluded.

Preferably, in accordance with the invention, the hot gas exhaust pipe is jacketed by the water supply pipe. With this construction, the exhaust pipe preheats the water before its entry into the spiral heat exchange tube. Water preheated by the hot exhaust gases absorbs less heat from the combustion process. Accordingly, the process of converting water into steam is more efficient since more heat energy is available for superheating the water and driving the steam ejected by the expansion nozzle into the earth formation.

In another aspect of the invention, a fuel preheat chamber including a spiral exhaust gas tube is provided to heat the incoming fuel. High temperature combustion gases from the top of the combustion chamber are fed to the tube by a feedback passage. These gases are then fed to the exhaust pipe inside the water supply pipe to aid in the water preheating process. A preheated fuel burns more efficiently and the preheated water is more easily raised to the required superheated level, thus greatly enhancing the efficiency of the steam generation.

In a further aspect of the present invention and in accordance with other objects and purposes, a downhole steam generator is described including pressure responsive doors for closing and opening the steam outlet of the steam generator in response to pressures within the steam outlet. Thus, if flameout occurs and steam pressure at the outlet is suddenly reduced, the pressure responsive doors close and prevent flooding of the heat exchange tube. In this way, the expansion nozzle and the heat exchange tube have positive protection from flooding and contamination by the reservoir fluids.

Still other objects and advantages of the present invention will become readily apparent to those skilled in this art from the following description, wherein I have shown and described only the preferred embodiment of the invention, simply by way of illustration of the best modes contemplated for carrying out the invention. As will be realized, the invention is capable of other and different embodiments, and its several details are capable of modification in various, obvious aspects, all without departing from the invention. Accordingly, the drawings and descriptions are to be regarded as illustrative in nature, and not as restrictive.

BRIEF DESCRIPTION OF THE DRAWINGS

The accompanying drawings, which are incorporated in and form a part of this specification, illustrate several aspects of the present invention, and, together with the description, serve to explain the principles of the invention. In the drawings:

FIG. 2 is a lateral cross-sectional view of the steam generator taken along lines 2—2 of FIG. 1 illustrating the fuel preheat chamber;

FIG. 3 is a lateral cross-sectional view taken along lines 3—3 of FIG. 1 illustrating the top of the combustion chamber;

FIG. 4 is a lateral cross-sectional view taken along lines 4—4 of FIG. 1 illustrating the bottom of the combustion chamber; and FIG. 5 is a lateral cross-sectional view taken along lines 5—5 of FIG. 1 illustrating the supply string including the water and oxidant preheating arrangement.

DETAILED DESCRIPTION OF THE INVENTION

Figure 1:
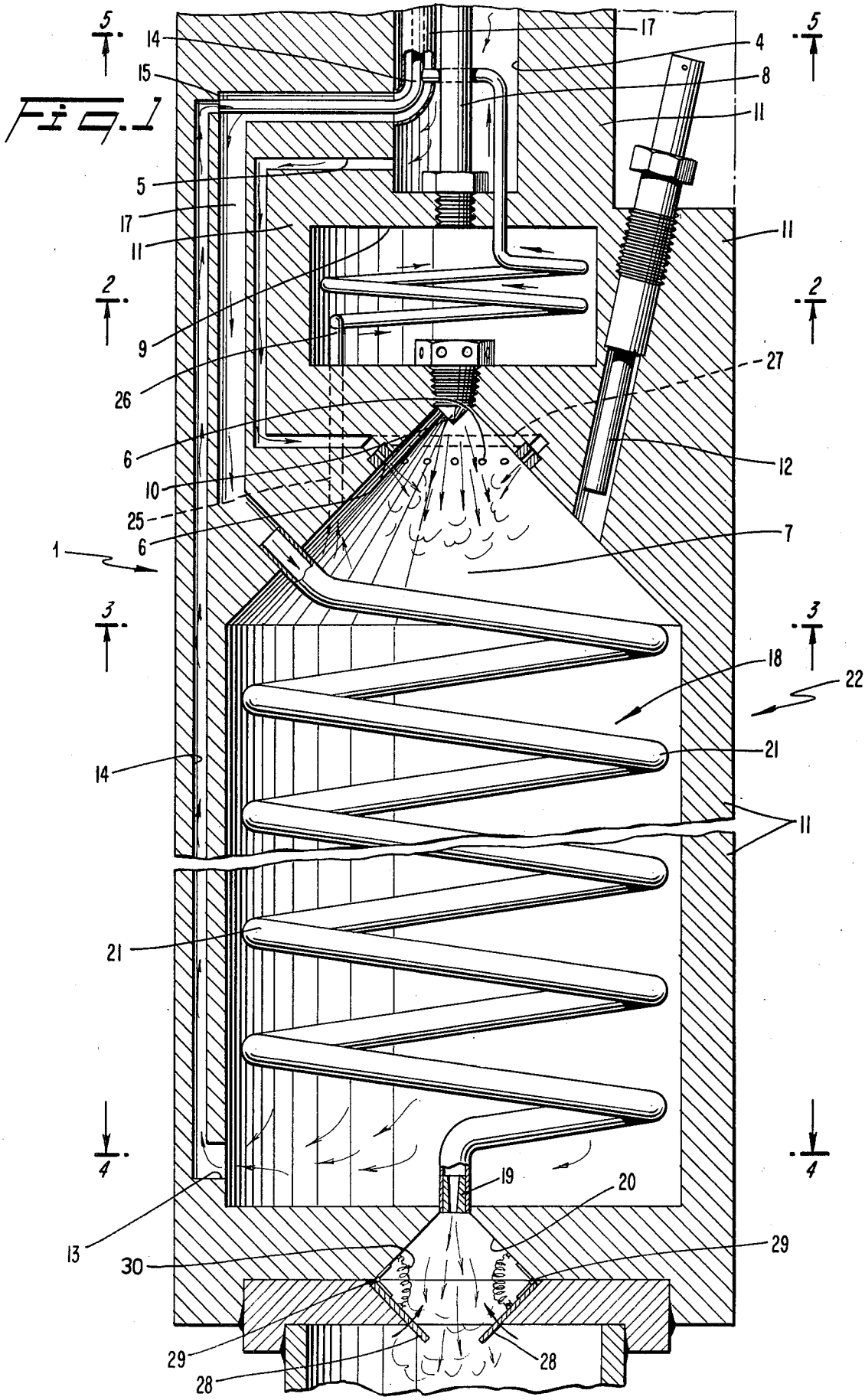
FIG. 1 is a longitudinal cross-sectional view partially broken away illustrating a downhole steam generator apparatus of the invention.

With reference to FIG. 1, in accordance with the invention, the apparatus 1 for generation of steam in a borehole for penetration in an earth formation comprises: an oxidant supply shaft 4; a supply line 8 for supplying fuel to be combusted when mixed with the oxidant; an igniter 12, such as a glow plug, for igniting the fuel and oxidant mixture; a supply line 17 for providing water to be superheated and converted to steam by the heat of combustion of the fuel/oxidant; and a combustor assembly 22.

The compressor assembly 22 has a plurality of oxidant inlet nozzles 6 (see FIG. 3) and a fuel inlet nozzle 10 supplying oxidant and fuel respectively to a combustion chamber 7.

Combustor assembly 22 also includes heat exchanger 18 having a spiral water heater or heat exchange tube 21 connected to water supply line 17. An expansion nozzle 19 and a steam outlet 20 are provided at the output end of the tube adjacent the bottom of the combustion chamber 7 (see FIG. 4).

As water enters heat exchange tube 21 from water supply line 17, heat from the combustion process in combustion chamber 7 is conducted through the walls to the water inside. The water is superheated, that is, elevated to a high temperature and maintained at a high pressure by restrictive expansion nozzle 19. As the superheated water emerges from nozzle 19, it immediately converts to steam and passes through steam outlet 20, into the borehole, and into the earth formation.

Products of combustion are vented out of the combustion chamber 7 by way of exit orifice 13 and connecting exhaust passage and pipe 14 extending to outside the borehole. The water from water supply line 17 and flowing through heat exchange tube 21, and exiting as steam from the nozzle 19 and the steam outlet 20, is advantageously completely isolated from the fuel, oxidant, and the products of combustion.

Because the steam generated is isolated from the combustion process, high pressure steam can be generated from a combustion process conducted at relatively low pressures. Thus, the fuel and oxidant need not be supplied to the combustion chamber at high pressures. As a result, high pressure air compressors and high pressure pumps for fuel are not needed for the downhole steam generator of the invention.

Another benefit derived from isolation of the combustion process from the actual steam generation is that there is no quenching of the combustion flame with water. Further, any soot formed by the combustion process is vented out of the downhole steam generator and is precluded from entering the borehole; and acidic products of combustion such as carbon dioxide, sulfur oxides, and nitrogen oxides are precluded from entering the earth formation.

Preferably, the oxidant is air and enters the combustion chamber by passing from air shaft 4 of the supply string (see FIG. 5) through feed passage 5 in housing 11 and through manifold 27 to a plurality of air inlet nozzles 6. The air is preheated by compression and by flowing around the water supply line 17 heated by the internal exhaust pipe 14.

Preferably, fuel from supply line 8 enters a fuel preheat chamber 9 prior to entrance into the combustion chamber 7 through the fuel nozzle 10. Preferred fuels are liquid fuels such as diesel fuel, fuel oil, kerosene, and the like. A portion of the combustion gases leaves combustion chamber 7 through feedback passage 25 and passes through the spiral exhaust gas preheater tube 26 in fuel preheat chamber 9. Preheater tube 26 emerges from the chamber 9 and connects with exhaust pipe 14 in the supply string. Heat from the relatively high pressure, hot combustion gases is transferred through the wall of the tube 26 to the fuel passing through the chamber 9. Thereby, the fuel is preheated prior to entrance into the combustion chamber 7. Preheated fuel lends itself to a more efficient combustion and results in the generation of less soot.

In accordance with another aspect of the invention, as shown in FIGS. 1 and 5, the exhaust passage and pipe 14 carrying the products of combustion from the bottom of the combustion chamber 7 merges into concentric relationship with water supply line 17 at junction 15 and extends out of the borehole and up to the surface outside. The concentric relationship with the water supply line 17 serves to form a highly efficient heat transfer relationship whereby virtually all of the heat from the hot products of combustion are stripped and transferred to the water, and indirectly to the oxidant. The exhaust gases are cool by the time they reach the surface and can be suitably treated to remove soot and other contaminants to prevent air pollution. Most importantly, since the water is preheated prior to its entrance into the heat exchanger 18, less heat generated in the combustion chamber is required to bring the water to the superheated state thereby allowing maximum energy to be available for driving the steam into the earth formation.

Pressure responsive doors 28 having hinges 29 are installed at the steam outlet 20. Hinges 29 may be biased closed by tension springs 30 against the force of the steam emerging under pressure from the expansion nozzle 19. Steam emerges from the outlet 20 so long as the steam pressure is greater than the back pressure within the borehole plus the pressure exerted by the springs 30. Conversely, in the event of a flameout, the springs 30 quickly close the doors 28 preventing contamination of the nozzle 19 and the heat exchange tube 21 by reservoir fluids.

During operation of the downhole steam generator, the water flow through water supply 17 is regulated so that the water entering the heat exchanger 18 is preheated and near the steam point. The water in heat exchanger 18 is preferably above the critical pressure for steam formation and is superheated to temperatures sufficiently high that upon emergence from nozzle 19 the reduction of pressure results in conversion to high enthalpy steam. Rates of fuel and oxidant consumption are controlled to optimize the conditions for preheating the water from the hot combustion products and for converting the water into steam.

Numerous benefits have been described which result from employing the concepts of the invention. By isolating the products of combustion in combustion chamber 7 from the water by utilizing the heat exchanger 17, soot and acidic combustion gases are vented and precluded from entering the borehole. The exhaust pipe 14 is mounted concentrically in the water supply line 17, thus preheating the water prior to entering the heat exchanger 18. This results in a more efficient utilization of the heat of combustion for driving the steam into the borehole. By feedback of a portion of the relatively high pressure hot combustion gases through fuel preheater chamber 9, fuel is also preheated prior to its entrance into the combustion chamber and this results in a more efficient combustion process. By using pressure responsive doors 28 at the steam outlet 20 contaminated water present in the borehole is prevented from entering the nozzle 19 and tube 21 of the heat exchanger 17 in the event of a flameout in the combustion chamber 7.

The foregoing description of an embodiment of the apparatus of the invention has been provided for purposes of illustration and description. It is not intended to be exhaustive or to limit the invention to the precise form disclosed. Obvious modifications and variations are possible in light of the above teachings.

The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An apparatus for generation of steam in a borehole for penetration into an earth formation, comprising an oxidant supply means;

a fuel supply means for supplying fuel;

an igniter means for igniting the fuel and oxidant mixture;

a water supply means for providing water to be converted to superheated water by the heat of combustion;

a combustor assembly having oxidant inlet means, fuel inlet means, a combustion chamber for generating hot combustion gases, a heat exchanger in said combustion chamber for at least superheating the water while maintaining separation between said water and the hot combustion gases, and nozzle means connected to said heat exchanger for converting the superheated water into steam and ejecting the steam into the borehole;

exhaust means connected to said combustion chamber for venting the hot gases of combustion out of the combustor assembly wherein said exhaust means includes an exhaust pipe, and said water supply means includes a water line, said exhaust pipe being mounted in said water line thereby serving to preheat the water before entry into said heat exchanger.

2. The steam generation apparatus of claim 1, further comprising fuel preheater tube means connected to said combustion chamber for receiving hot combustion gases, said fuel preheater tube being mounted in a preheater chamber, said fuel supply means being connected to said preheat chamber, whereby fuel is preheated before entering said combustion chamber.

3. The steam generation apparatus of claim 2 wherein said fuel preheater tube comprises an outlet port which is operably connected to said exhaust pipe for exhausting hot combustion gases after preheating said fuel.

4. An apparatus for generation of steam in a borehole for penetration into an earth formation, comprising an oxidant supply means;

a fuel supply means for supplying fuel;

an igniter means for igniting the fuel and oxidant mixtures;

a water supply means for providing water to be converted to superheated water by the heat of combustion;

a combustor assembly having oxidant inlet means, fuel inlet means, a combustion chamber for generating hot combustion gases, a heat exchanger in said combustion chamber for at least superheating the water while maintaining separation between said water and the hot combustion gases, and nozzle means connected to said heat exchanger for converting the superheated water into steam and injecting the steam into the borehole, said fuel inlet means comprising a fuel preheat chamber; and fuel preheater tube means connected to said combustion chamber for receiving hot combustion gases, said fuel preheater tube being mounted in the preheat chamber, said fuel supply means being connected to said preheat chamber, whereby fuel is preheated before entering said combustion chamber.

* * * * *